US005272410A

United States Patent [19]

Fox

[11] Patent Number: 5,272,410

[45] Date of Patent: Dec. 21, 1993

[54] RADIATION-EMITTING PANELS AND DISPLAY ASSEMBLIES

[75] Inventor: Neil A. Fox, Eversham, England

[73] Assignee: Smiths Industries Public Limited Company, London, England

[21] Appl. No.: 40,092

[22] Filed: Mar. 30, 1993

Related U.S. Application Data

[63] Continuation of Ser. No. 681,550, filed as PCT/GB90/00075, Jan. 18, 1990, abandoned.

[30] Foreign Application Priority Data

Feb. 11, 1989 [GB] United Kingdom ..... 8903118

[51] Int. Cl.[5] ..... H01J 61/30; H01J 17/16

[52] U.S. Cl. ..... 313/113; 313/493; 313/634; 362/260; 362/97

[58] Field of Search ..... 313/493, 634, 113, 111, 313/422; 220/2.1 R; 362/260, 225, 97

[56] References Cited

U.S. PATENT DOCUMENTS

| | | | |
|---|---|---|---|
| 2,102,049 | 12/1937 | Warren | 313/111 X |
| 2,555,749 | 6/1951 | Krefft | 313/493 |
| 4,767,965 | 8/1988 | Yamano et al. | 313/493 X |
| 4,839,555 | 6/1989 | O'Mahoney | 313/493 |
| 4,920,298 | 4/1990 | Hinotani et al. | 313/493 |

FOREIGN PATENT DOCUMENTS

| | | | |
|---|---|---|---|
| 46568 | 3/1983 | Japan . | |
| 206553 | 8/1989 | Japan | 313/634 |
| 2217905 | 11/1989 | United Kingdom . | |

*Primary Examiner*—Donald J. Yusko
*Assistant Examiner*—Nimesh Patel
*Attorney, Agent, or Firm*—Pollock, Vande Sande and Priddy

[57] ABSTRACT

A flat, light-emitting discharge panel, such as for back lighting displays, has two parallel transparent glass plates which are spaced by rows of pyramid-shape pillars. The pillars are formed integrally with at least one of the plates. The space between the two plates contains a discharge gas at reduced pressure, the inner surface of the plates and the surface of the pillars being coated with a phosphor which emits light on discharge in the panel. The outer surface of one plate has a reflector which reflects emitted light through the panel to the display. The pillars have angled surfaces which reflect light out of the panel and which act as light guides.

9 Claims, 2 Drawing Sheets

RADIATION-EMITTING PANELS AND DISPLAY ASSEMBLIES

This application is a continuation of Ser. No. 07/681,550, filed as PCT/GB90/00075, Jan. 18, 1990, now abandoned.

BACKGROUND OF THE INVENTION

This invention relates to radiation-emitting panels of the kind having two parallel plates sealed with one another around their edges and enclosing a gas-discharge volume at reduced pressure, at least one of the plates being transparent to the radiation.

In many applications, it is desired to be able to produce even illumination over a large area, such as when back lighting instruments. Preferably, the illumination is of high intensity with a low power and heat dissipation while being compact and of light weight.

Fluorescent lighting, in which light is generated by photo-ionization of a phosphor layer in a gas-discharge tube, is ideally suited to this, as far as the level of illumination and power dissipation is concerned. Where even illumination is required over a large area, however, it is necessary either to use several fluorescent tubes in parallel with one another or to use a tube that is bent, in an attempt to produce an even distribution of light. In WO 87/04562 there is described a display in which an arrangement of parallel tubes is reproduced in a flat panel by means of walls that divide the panel into separate discharge paths, each having its own electrode. A bent tube arrangement is similarly reproduced by walls defining a circuitous path between two electrodes. It is usually also necessary to use some form of diffuser in front of such arrangements to produce a more even illumination. This does still not produce illumination which is distributed sufficiently evenly for some applications because of the presence of the walls.

WO 87/04562 also describes a flat panel fluorescent device formed by two glass plates coated with phosphor on their facing surfaces. The plates are spaced from one another and sealed around their edges, the space between the plates being evacuated to a low pressure. Electrodes extend along opposite edges inside the space between the plates, so that discharge can be produced between them. The problem with this construction is that, because of the reduced pressure within the device the plates must be relatively thick to be able to withstand the pressure differential across them. This leads to a device which is relatively heavy and bulky.

It is an object of the present invention to provide a radiation-emitting panel which can be used to avoid these disadvantages.

SUMMARY OF THE INVENTION

According to one aspect of the present invention there is provided a radiation-emitting panel of the above specified kind having two parallel plates sealed with one another around their edges and enclosing a gas-discharge volume at reduced pressure, wherein the plates are transparent to the radiation and at least one of the plates has a phosphor coating on an inner surface which generates the radiation on discharge within the panel, characterized in that one of the plates has a reflective outer surface which reflects radiation, that the plates are supported within their edges by a plurality of radiation-transmitting pillars having sloping, angled surfaces that reflect radiation externally and internally of the pillars and such that the pillars act as light guides for radiation reflected from the reflective outer surface on one plate to the other plate.

The pillars preferably have a phosphor coating thereon. These pillars may be located in a plurality of rows, and the diameter of the pillars along each row may be substantially equal to the separation between adjacent pillars along the row. Pillars in one row are preferably staggered from pillars in an adjacent row by a distance equal to the diameter of the pillars, and the edges of adjacent rows may be contiguous. The pillars are preferably of a frusto-pyramid shape. At least one of the plates may have pillars formed integrally therewith.

According to another aspect of the present invention there is provided a display assembly including a display and radiation emitting panel located behind the display such that radiation emitted by the panel backlights the display, characterized in that the panel is according to the above one aspect of the present invention.

BRIEF DESCRIPTION OF THE DRAWINGS

A light-emitting panel and a display assembly including such a panel, according to the present invention, will now be described, by way of example, with reference to the accompanying drawings, in which.

DESCRIPTION OF THE PREFERRED EMBODIMENTS

Figure 1:
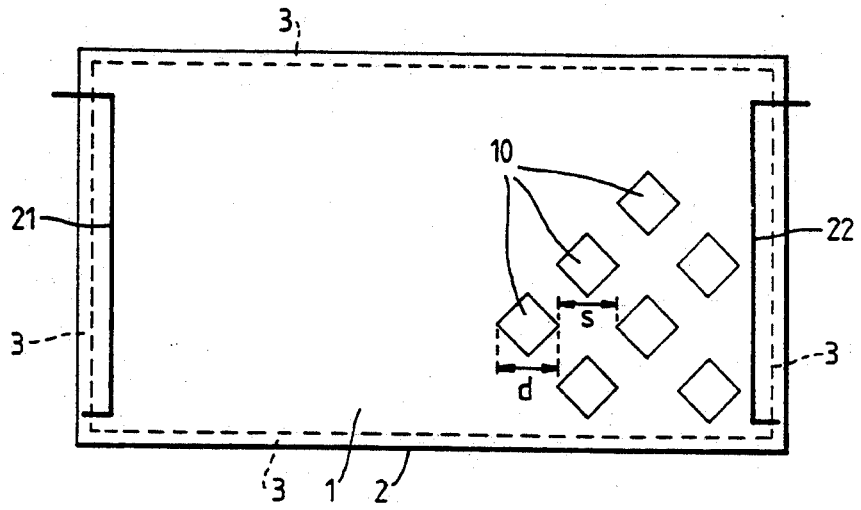
FIG. 1 is a plan view of the panel.
Figure 2:
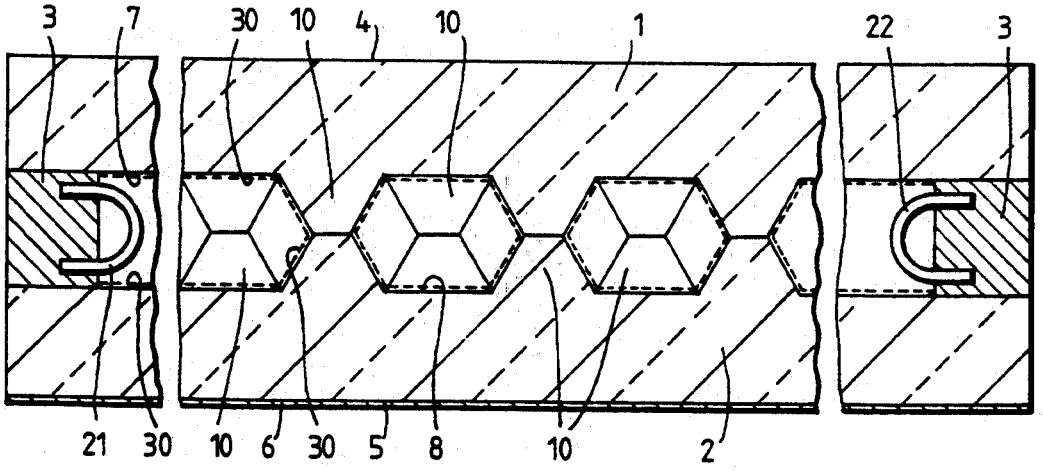
FIG. 2 is a cross-sectional side elevation view of the panel to an enlarged scale.
Figure 3:
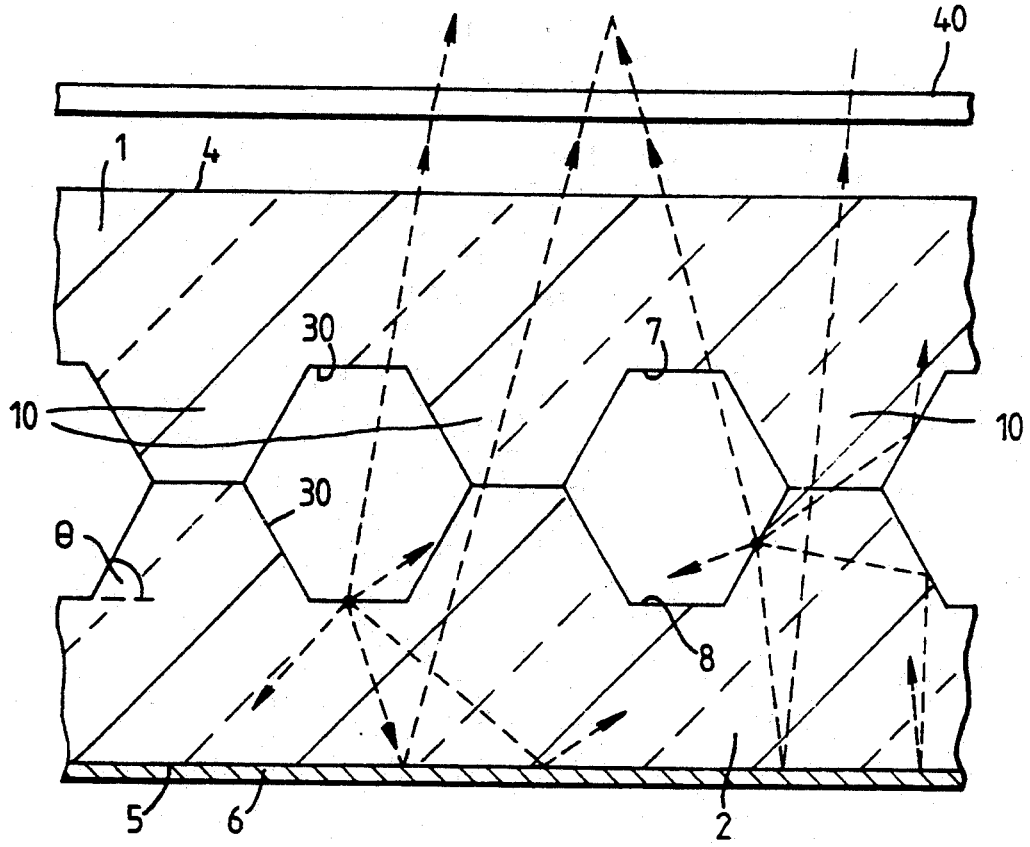
FIG. 3 is a sectional view of a display assembly including the panel and illustrating ray paths within the panel.

With reference to FIGS. 1 to 3, the light-emitting panel comprises two rectangular glass plates 1 and 2 which are both transparent to light. An electrically-insulative spacer 3, which may be formed by glass bars, is interposed between the two plates around their edges to separate them from each other and to form a gas-tight seal between them. The outer surface 4 and 5 of both plates 1 and 2 is flat and plane, the surface 5 of the lower plate 2 abutting a plane relector 6 which may be a specularly reflecting metal coating or a diffusely reflecting colored coating.

The inner surface 7 and 8 of both plates 1 and 2 is interrupted by an array of pillars 10. The pillars 10 are of square section and frusto-pyramidal shape being typically of width 0.707 mm giving a diagonal diameter of 1 mm at their base, with a wall angle $\theta$ of 60 degrees to the horizontal and a height of 0.433 mm. The pillars are arranged in straight rows, horizontal in FIG. 1, with spacings between adjacent pillars in a row equal to the base diameter of the pillars. Pillars 10 in adjacent rows are staggered from one another by a distance equal to the diameter of the pillars, so that the pillars 10 of one row are aligned midway between pillars of an adjacent row. The edges of adjacent rows are contiguous so that there is no space between adjacent rows.

The array of pillars on the two plates 1 and 2 are identical, so that the top of each pillar 10 on one plate is aligned with, and contacts, the top of a corresponding pillar on the opposite plate. The abutting top surfaces of the pillars 10 on the two plates are joined by an adhesive of refractive index matched to that of the glass forming the plates. The spacing between the two plates is, therefore, equal to the sum of the height of the pillars on the two plates.

Along opposite, vertical, sides, inside the panel, are mounted two electrodes 21 and 22 respectively which are sealed into the spacer 3 and have an electrical conductor extending out through the spacer by which a voltage can be applied. Each electrode 21 and 22 extends along substantially the entire length of one side of the panel, at right angles to, and across the ends of all the rows of pillars. The electrodes 21 and 22 are preferably unheated so that the panel forms a gas-discharge device of the cold-cathode kind. In alternative arrangements, a hot-cathode electrode configuration could be used. The electrodes could be formed by a thick, conductive coating on the spacers 3. The arrangement of the invention only requires one set of electrodes in contrast with some previous arrangements, thereby avoiding previous problems of interference between different sets of electrodes and their respective discharges.

The space inside the panel contains a mixture of argon gas and mercury vapor or other gases and gas mixtures at low pressure. The exposed surfaces inside the panel, that is, the flat, inner surface of the two plates 1 and 2, between the pillars 10, and the walls of the pillars, are coated with one or more layers 30 of phosphor which emit the desired radiation spectrum when caused to fluoresce by a gas-discharge.

In operation, a high voltage is applied between the two electrodes 21 and 22 sufficient to cause discharge within the panel which in turn causes fluorescence of the phosphor layer 30. Discharge between the two electrodes 21 and 22 results in production of a plasma that is unconfined by any internal barriers within the panel and that is therefore uniformly distributed within the panel around the pillars 10. Light emitted from the phosphor layer 30 travels both into the gas space between the plates 1 and 2 and into the glass material supporting the phosphor layer, as illustrated in FIG. 3. The sloping walls of the pillars 10 causes any light entering the pillar to be eventually reflected towards the outer surface 4 or 5 of the plate 1 or 2. In this respect, it is preferable for the angle of the walls of the pillars where they meet the surface of the plate, to be less than 90 degrees. Light incident on the lower surface 5 will be reflected by the reflector 6 towards the upper plate 1. The pillars 10 act as light guides which enable a significant proportion of this light reflected by the reflector 6 to pass directly out of the outer surface 4 of the panel without suffering attenuation by absorption in the phosphor layer 30. In this way, when the panel is viewed, the light emitted in the region of the base of the pillars 10 is substantially the same as that from the regions around the pillars. Any slight difference in levels of illumination of these regions has very little effect on the overall even appearance of illumination because of the even distribution of the pillars, their small width and the fact that they are surrounded by the flat surface of the plate.

The pillars 10 reduce by about 20% the flat area of the inner surface 7 and 8 of the plates. The exposed walls of the pillars 10, however, have a surface area of about 38% of the flat area giving an increase of about 18% in the area of the phosphor layer 30 over that which would be provided by two flat plates. The pillars also lead to a more efficient utilization of light emitted into the lower plate because of their light-guiding ability.

The pillars also give structural support to the panel against forces normal to the panel. This enables the plates 1 and 2 to be relatively thin since the pillars ensure that they maintain their correct separation. The panel can, therefore, be considerably lighter and thinner than equivalent panels which do not employ pillars. For example a panel that is 100 mm square can be made from plates only 2 mm thick giving an overall thickness of about 5 mm.

The present invention enables a panel to be provided of high uniformity of illumination and with highly unidirectional emission. It will be appreciated however, that bi-directional panels could be provided by omitting the reflector so that light emerges from both sides.

The pillars 10 on the plate 1 and 2 could be made by any conventional technique such as by chemical etching, mechanical or ion machining or by laser ablation techniques.

Figure 4:
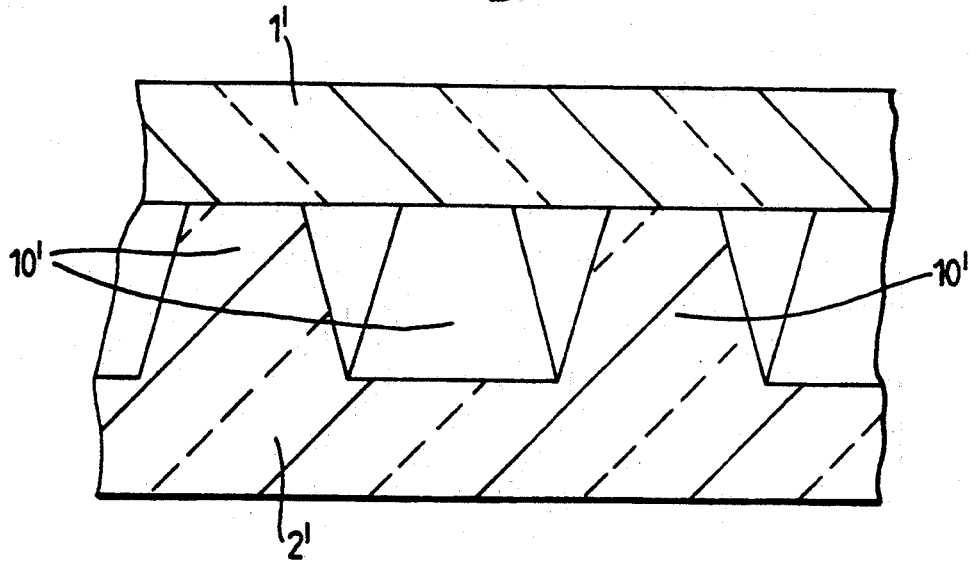
FIG. 4 is a cross-sectional side elevation of an alternative panel.

Instead of forming pillars on both plates, they could be formed on just one plate 2', as shown in FIG. 4. In this arrangement, the pillars 10' slope in the same sense along their length. It can be seen, with this arrangement, that light will be preferentially directed into the lower plate 2' and that any reflector is preferably supported by the upper plate 1'.

Alternatively, the pillars could be formed as components separate from both plates and subsequently joined to one or both plates. In order not to reduce the amount of light transmitted from such pillars into the plates, it is desirable for the joints between the pillars and the plates to be made with an optical cement having the same refractive index as the glass of the pillars and plates.

The pillars need not be frusto-pyramid in shape but could be of other shapes such as frusto-conical A four-sided pyramid shape may, however, be easier to make by machining than conical shapes. The outer surface of the plates need not be flat but could be profiled, such as to provide focussing or dispersion of light.

Light-emitting panels of this kind could be used for many different purposes. They may, for example, be included in display assemblies to rear-light an advertisement or instrument display, such as incorporating a liquid crystal matrix display 40 (FIG. 3). They could also be used in other applications where even illumination is required such as in photographic applications, or for room lighting with reduced shadowing.

I claim:

1. A radiation-emitting panel having two parallel plates, each having a peripheral edge, sealed with one another around their peripheral edges and enclosing a gas-discharge volume at a low pressure, a pair of electrodes spaced from one another in said gas-discharge volume, said plates being transparent to the radiation, at least one of the plates having a phosphor coating on an inner surface which generates the radiation on discharge within the panel, one of the plates having a reflective outer surface which reflects radiation, the plates being supported within said peripheral edges by a plurality of radiation-transmitting pillars extending from both plates, each pillar on one plate having a flat top that abuts a flat top on a pillar on the other plate, the pillars having sloping angled surfaces, said angled surfaces being operative to reflect radiation externally and internally of the pillars such that the pillars act as light guides for radiation reflected from said reflective outer surface on one plate to the other plate, said phosphor coating being so disposed that it is absent from the flat tops of the pillars so that radiation can pass freely between said two plates via said pillars without having a pass through the phosphor.

2. A panel according to claim 1 wherein the pillars are formed integrally with the plates.

3. A display assembly including a display and a radiation-emitting panel according to claim 1.

4. A radiation-emitting panel having two parallel plates, each having a peripheral edge, sealed with one another around their peripheral edges and enclosing a gas-discharge volume at a low pressure, a pair of electrodes spaced from one another in said gas-discharge volume, said plates being transparent to the radiation, at least one of the plates having a phosphor coating on an inner surface which generates the radiation on discharge within the panel, one of the plates having a reflective outer surface which reflects radiation, the plates being supported within said peripheral edges by a plurality of radiation-transmitting pillars that extend from one of the plates, each pillar having a flat top surface that abuts a region on the other plate and each pillar having sloping angled surfaces, said angled surfaces being operative to reflect radiation externally and internally of the pillars such that the pillars act as light guides for radiation reflected from said reflective outer surface on one plate to the other plate, said phosphor coating being so disposed that it is absent from the flat top surfaces of the pillars and the regions of said other plate abutted by the pillars so that radiation can pass freely between said two plates via said pillars without having to pass through the phosphor.

5. A panel according to claim 1 wherein the pillars are of a frusto-pyramid shape.

6. A panel according to claim 1 or 4 wherein the sloping angled surfaces of the pillars have a phosphor coating thereon.

7. A panel according to claim 1 or 4, wherein in that the pillars (10) are located in a plurality of rows, the diameter (d) of each of the pillars along each row being substantially equal to the separation (s) between adjacent pillars along the row.

8. A panel according to claim 7, wherein the pillars in one row are staggered from pillars in an adjacent row by a distance equal to the diameter (d) of each of the pillars.

9. A panel according to claim 7 wherein each row of pillars has an edge, and the edges of adjacent rows are contiguous.

* * * * *